US010589922B2

(12) United States Patent
Valsecchi et al.

(10) Patent No.: US 10,589,922 B2
(45) Date of Patent: Mar. 17, 2020

(54) CAPSULE FOR PRODUCING BEVERAGES

(71) Applicant: Gruppo Gimoka S.r.l., Trezzano sul Naviglio (IT)

(72) Inventors: Massimiliano Valsecchi, Andalo Valtellino (IT); Massimo Faravelli, Andalo Valtellino (IT)

(73) Assignee: Gruppo Gimoka S.r.l., Trezzano sul Naviglio (IT)

( * ) Notice: Subject to any disclaimer, the term of this patent is extended or adjusted under 35 U.S.C. 154(b) by 140 days.

(21) Appl. No.: 15/664,699

(22) Filed: Jul. 31, 2017

(65) Prior Publication Data

US 2017/0327308 A1 Nov. 16, 2017

Related U.S. Application Data

(63) Continuation of application No. PCT/IB2017/051044, filed on Feb. 23, 2017.

(30) Foreign Application Priority Data

Feb. 23, 2016 (IT) ..... 102016000018671
Oct. 31, 2016 (IT) ..... 102016000109774
Feb. 22, 2017 (IT) ..... 102017000020172

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS 7,604,826 B2 10/2009 Denisart et al.
2010/0043645 A1* 2/2010 Suggi Liverani ... A47J 31/0668 99/295

(Continued)

FOREIGN PATENT DOCUMENTS

CN 105231824 1/2016
CN 105564843 5/2016

(Continued)

OTHER PUBLICATIONS

Italian Search Report and Written Opinion for Italian Patent Application No. IT 102016000018671 dated Oct. 14, 2016 with English translation.

(Continued)

*Primary Examiner* — Viren A Thakur
*Assistant Examiner* — Chaim A Smith
(74) *Attorney, Agent, or Firm* — McCarter & English, LLP

(57) ABSTRACT

A capsule for producing a beverage in an automatic beverage production device is provided that includes a cup-shaped body defined by a lateral wall and a bottom wall with a beverage outflow opening closed by a sealing film, and a filter member provided with a perforation member and extending transversely so as to ideally divide the cup-shaped body into an upper part containing the substance to be brewed, and a lower part containing a chamber for collecting the beverage. The bottom wall comprises an annular portion extending transversely to the capsule axis to define a stable support base for the capsule when the latter is arranged in a corresponding percolation seat of the automatic beverage production device. The lower part comprises a geometric discontinuity area shaped and/or sized so as to result, when the capsule is externally axially compressed, in the lower part of the cup-shaped body deforming substantially at the (Continued)

geometric discontinuity area, and in the perforation member resultingly displacing through the sealing film.

6 Claims, 13 Drawing Sheets

(56) References Cited

U.S. PATENT DOCUMENTS

| | | | | |
|---|---|---|---|---|
| 2010/0260895 | A1 | 10/2010 | Yoakim et al. | |
| 2012/0121779 | A1* | 5/2012 | Lai | A47J 31/3623 426/433 |
| 2014/0373725 | A1* | 12/2014 | Mastropasqua | B65D 85/8043 99/295 |

FOREIGN PATENT DOCUMENTS

| | | |
|---|---|---|
| EP | 1580143 | 9/2005 |
| EP | 1580144 | 9/2005 |
| EP | 1472156 | 3/2006 |
| EP | 1808382 | 3/2013 |
| EP | 2998242 | 3/2016 |
| EP | 3088331 | 11/2016 |
| ES | 2234445 | 6/2005 |
| WO | WO 2005/092160 | 10/2005 |
| WO | WO 2008/125256 | 10/2008 |
| WO | WO 2008/132571 | 11/2008 |
| WO | WO 2012/121597 | 9/2012 |
| WO | WO 2013/124234 | 8/2013 |
| WO | WO 2014037339 | 3/2014 |
| WO | WO 2014/102701 | 7/2014 |
| WO | WO 2014184404 | 11/2014 |
| WO | WO 2015/049270 | 4/2015 |
| WO | WO 2015049270 | 4/2015 |
| WO | WO 2015177591 | 11/2015 |
| WO | PCT/IB2017/051044 | 2/2017 |

OTHER PUBLICATIONS

Italian Search Report and Written Opinion for Italian Patent Application No. IT 10201600109774 dated May 15, 2017 with English translation.

PCT International Search Report and Written Opinion dated May 29, 2017 for PCT/IB2017/051044.

Italian Search Report and Written Opinion for IT 102017000020172 dated Sep. 14, 2017.

* cited by examiner

CAPSULE FOR PRODUCING BEVERAGES

CROSS-REFERENCE TO RELATED APPLICATIONS

This application claims priority benefit to co-pending International Application No. PCT/IB2017/051044, filed on Feb. 23, 2017, which claims priority to Italian Patent Application 102016000018671, filed on Feb. 23, 2016; Italian Patent Application 102016000109774, filed Oct. 31, 2016, and Italian Patent Application No. 102017000020172, filed Feb. 22, 2017.

TECHNICAL FIELD

The present invention relates to a capsule for producing a beverage. In particular, the present invention relates to a capsule commonly used in a brewing assembly comprising a seat adapted to accommodate the capsule and a dispensing head for supplying a pressurised fluid in the capsule.

STATE OF THE ART

As is known, the cup-shaped seat and the dispensing head are normally mutually movable between an operating position, in which the cup-shaped seat and the dispensing head are mutually coupled in a fluid-tight manner, and a rest position, in which the seat and the dispensing head are separate to allow a capsule to be manually or automatically loaded in the seat.

The capsule comprises a cup-shaped body bounded by a lateral wall and a bottom wall; a cover to close the cup-shaped body; a disk arranged in the cup-shaped body; and a chamber for containing a substance to be brewed and bounded by the disk, the cover, and the lateral wall of the cup-shaped body.

The substance contained in the chamber is a substance in the form of a liquid, concentrate or granulate, such as, for example, coffee powder, tea leaves, cocoa, powdered milk, granulated broth.

The disk has a plurality of through openings adapted to be flown through by a beverage obtained responsively to a pressurised fluid being supplied in the chamber.

In general, to produce a good quality beverage, it is desirable that a pre-brewing phase occurs following the injection of a pressurised fluid in the chamber, to allow the fluid to penetrate in a substantially uniform manner the substance to be brewed before flowing out of the capsule.

Several solutions have been proposed for this purpose, many of which involve the use of a membrane arranged in the chamber to seal the chamber and configured to be perforated or torn by relative engagement with perforating members carried by the disk, when the pressure in the chamber reaches a predetermined value. Capsules of this type are described, for example, in EP 1 472 156 B and EP 1 808 382 B1.

Other capsules are known from EP 1 580 143, EP 1 580 144 and WO 2008/132571.

In particular, EP 1 580 143 and EP 1 580 144 disclose to a cartridge for extracting a beverage from a particulate substance contained therein by means of water under pressure, the cartridge comprising: a main body comprising a cup portion and a lid portion, the cup portion comprising a base, a sidewall and a rim opposed to the base, the lid portion being fixedly attached to the rim of the cup portion so as to define an internal volume of the cartridge, the internal volume of the cartridge housing the particulate substance comprised within filtering means for retaining the particulate substance and for percolating fluid substances therethrough, the lid portion comprising a normally closed lid port defining a first passage for percolation fluid substances when it is opened, characterized in that it comprises a tappet arranged inside the internal volume so as to pierce the base when a pressure is applied to the base towards the internal volume, thus opening a normally closed cup port.

WO 2008/132571 discloses to a capsule for containing doses of soluble drinks comprising a container body which defines an inner cavity in which a solution chamber for a dose of soluble drink and an opening are defined, the body also defining an inlet shaped like a tray for receiving a dispenser pipe, said inlet being arranged eccentrically with respect to the solution chamber and connected thereto through a passage, the opening and the inlet being closed by a shaped lid, which is made of perforable material and which centrally shapes a hollow seat and a folded annular portion that extends inside the solution chamber for forming a forced path for hot water under pressure dispensed from the dispenser pipe; a substantially cylindrical body seat is provided inside, which has an exit opening that is initially closed by a sheet of perforable material, whereby a perforator is slidingly arranged inside said substantially cylindrical seat, and whereby said lid is able to be bent towards the bottom, when the dispenser pipe penetrates the tray, so as to push said perforator for perforating said sheet.

OBJECT OF THE INVENTION

Aim of the present invention is to provide a capsule of the above-specified type to produce a beverage, which capsule is easy and inexpensive to be produced and fails to require injection internal pressure-operated opening members to open the capsule.

According to the present invention, a capsule for producing a beverage is provided, as claimed in the appended claims.

BRIEF DESCRIPTION OF THE DRAWINGS

The invention will now be described with reference to the accompanying drawings, which show a non-limiting embodiment thereof, and in which.

PREFERRED EMBODIMENTS OF THE INVENTION

Figure 1:
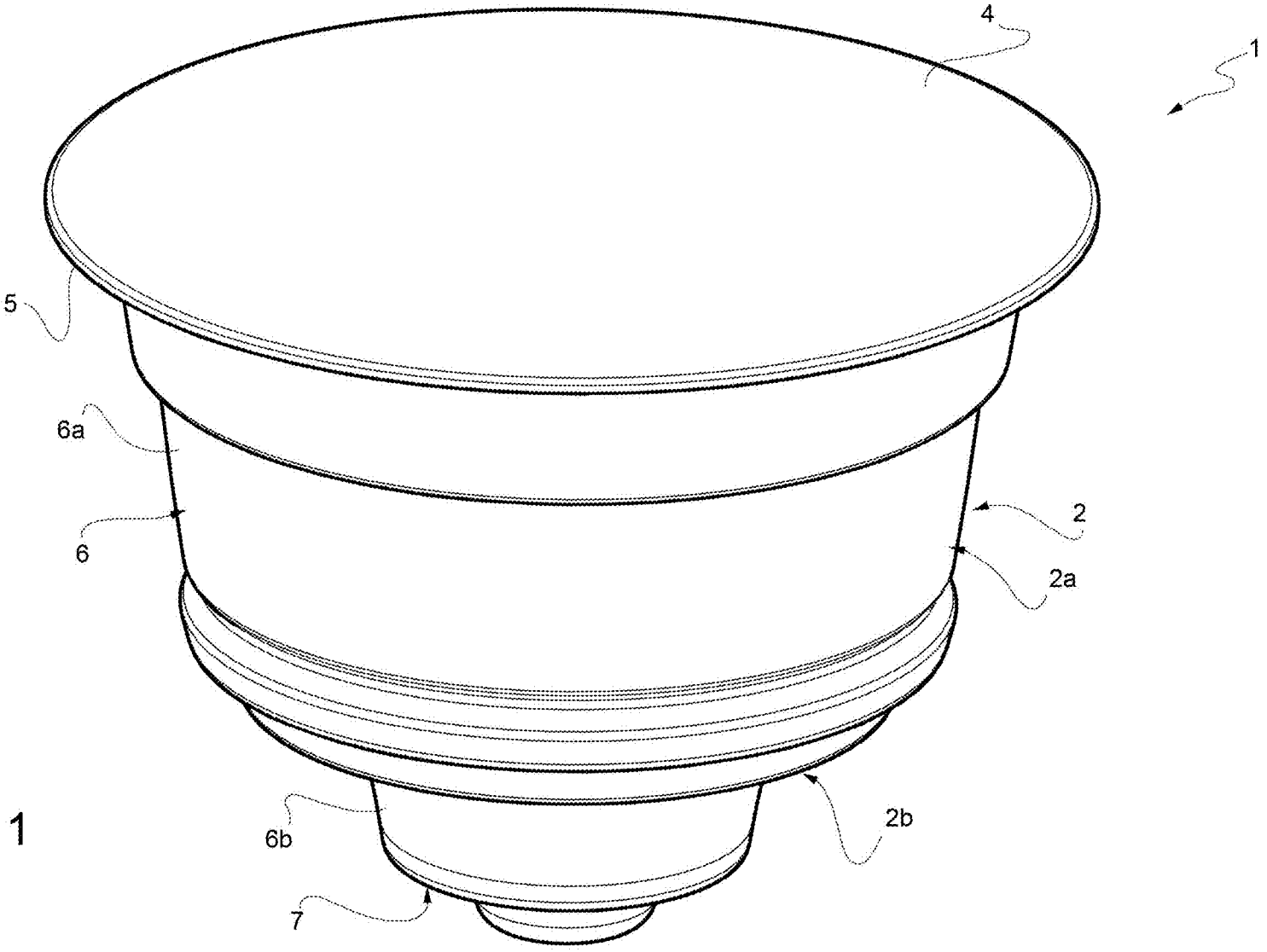
FIG. 1 is a perspective view of a capsule according to a preferred embodiment of the present invention.

In FIG. 1, the reference numeral 1 indicates, as a whole, a capsule adapted to contain a brewing substance or a soluble substance for producing a beverage, such as, for example, coffee, tea, cocoa, milk, broth, etc.

The capsule 1 is adapted to be used in well-known automatic beverage production devices, wherein the beverage production process comprises sealing the capsule in a seat and supplying a hot or cold fluid, usually water, in the capsule at a given pressure so as to percolate or dissolve the substance in the capsule and thus obtain a beverage.

Figure 2:
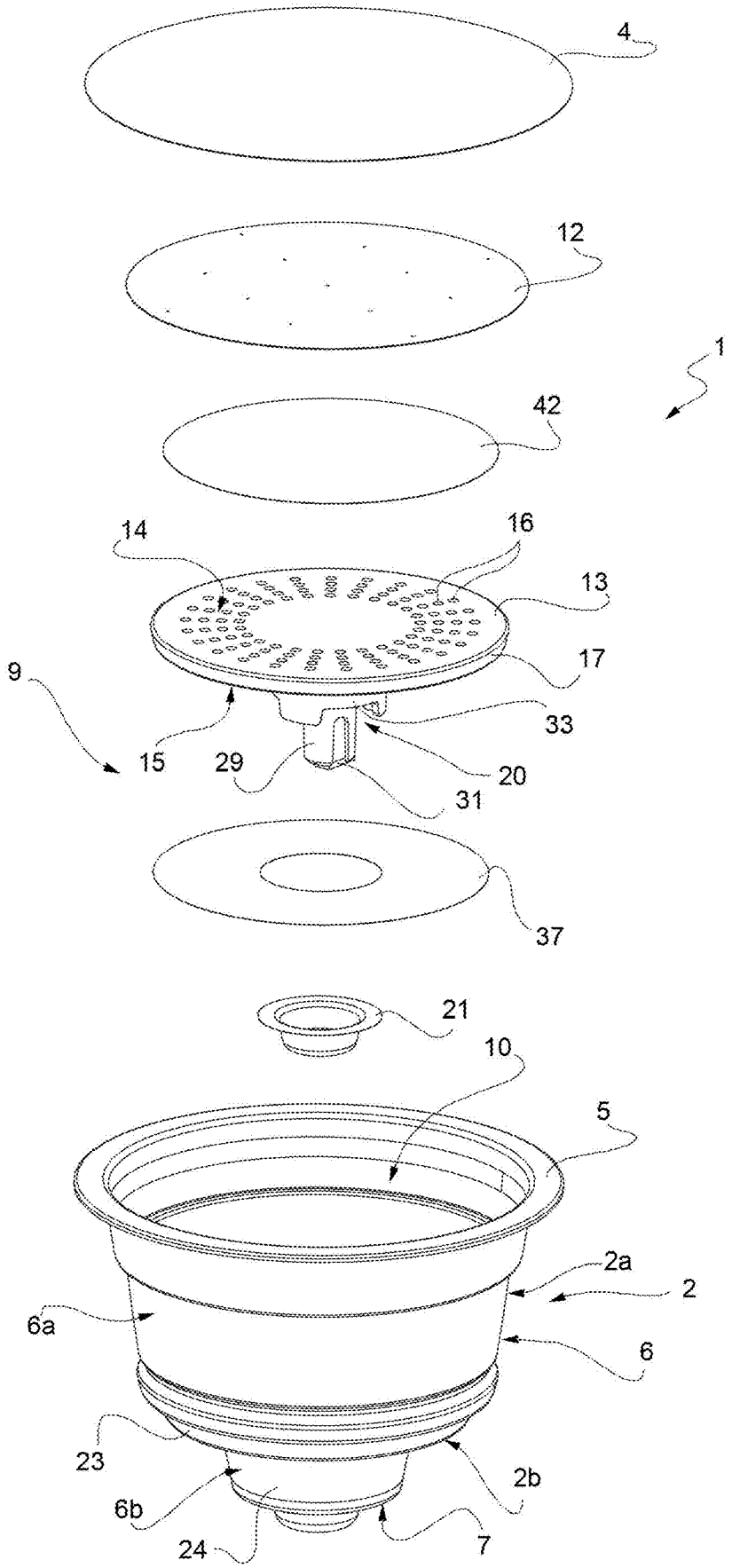
FIG. 2 is an exploded perspective view of the capsule of FIG. 1.
Figure 3:
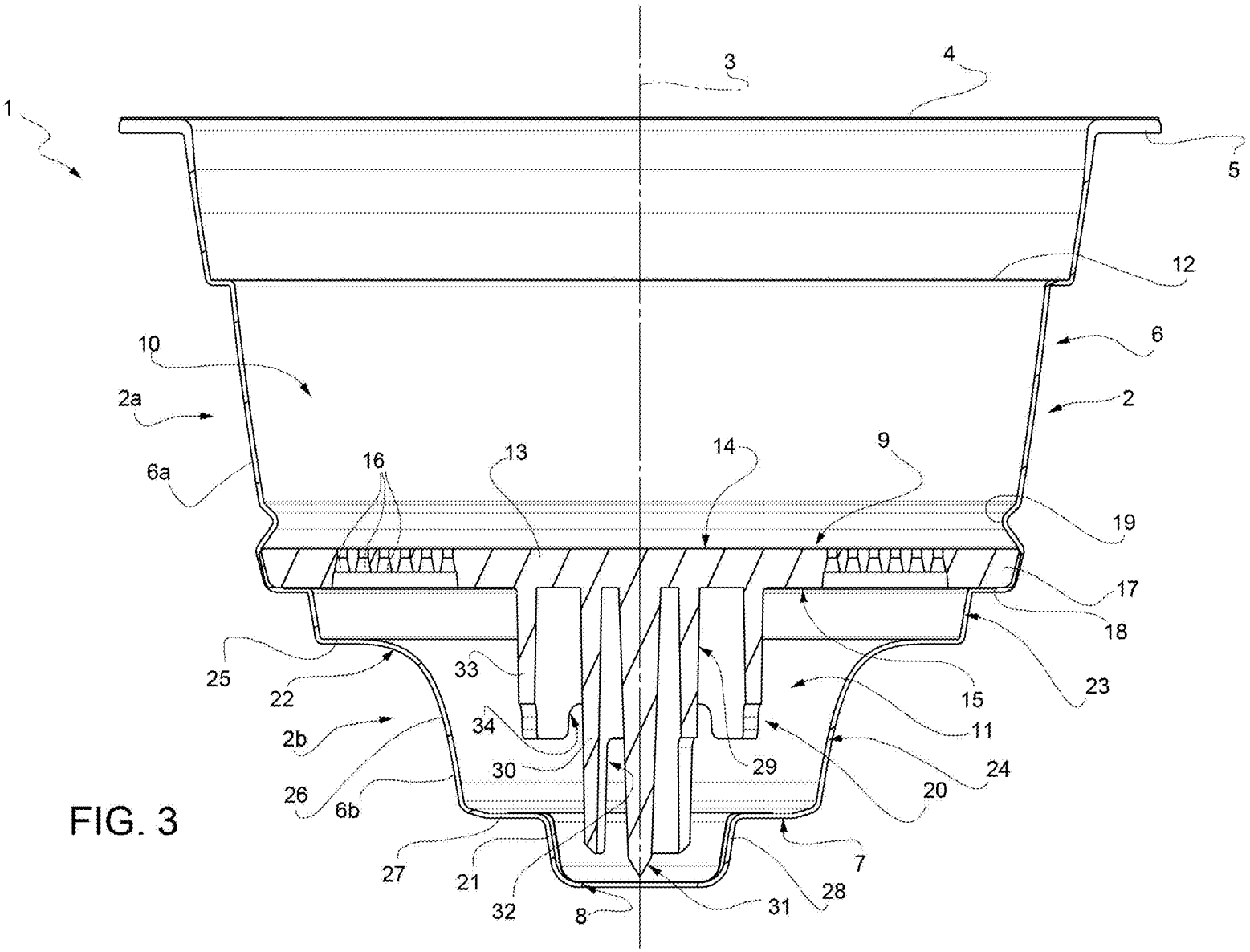
FIG. 3 is a longitudinal section of the capsule of FIG. 1.

As shown in FIGS. 1, 2 and 3, the capsule 1 comprises a cup-shaped body 2, which has a longitudinal axis 3 and is closed at its upper end by a cover 4 made of a mono- or multi-layer film of plastic and/or metal material, which is seal-welded to an outer annular flange 5 of the cup-shaped body 2 and adapted to be perforated, in use, by a perforating device of the beverage production device (which will be discussed hereinafter) to allow a fluid, typically water, to be injected in the capsule 1 at a given temperature and pressure.

The cup-shaped body 2 comprises a lateral wall 6, which is coaxial with the axis 3 and, preferably, but not necessarily, has a shape that is generally flared towards the annular flange 5, and a bottom wall 7, which extends in a direction generally transverse to the axis 3 and has a beverage outflow opening 8.

The cup-shaped body 2 is made of an impermeable material, preferably a plastic material for food use, in particular Polypropylene (PP) or Polybutylene terephthalate (PBT), and can be obtained through any moulding process suitable for the purpose, in particular by thermoforming.

As shown in FIG. 1, the capsule 1 further comprises a filter member 9, which extends inside the capsule 1 in generally transversely to the axis 3 so as to divide the interior of the capsule 1 into an upper chamber 10, which is adapted to contain the brewing or soluble substance, and a lower or collection chamber 11, into which the beverage from the chamber 10 flows and then flows out of the capsule 1 through the beverage outflow opening 8.

Depending on the type and amount of substance contained in the capsule 1 and/or the degree of compaction required for the substance, the substance in the chamber 10 may occupy all or only part of the space between the filter member 9 and the cover 4.

In particular, if, as in the capsule shown in FIG. 1, the substance is a brewing substance, for example coffee, the volume of the chamber 10 occupied by the substance is bounded at the bottom by the filter member 9 and at the top by a micro-perforated sheet 12, which is welded to the lateral wall 6 and arranged at a certain distance from the cover 4. The micro-perforated sheet 12 serves the further purpose of favouring an even distribution and penetration of the brewing fluid in the substance when the brewing fluid is fed into the capsule 1 through the cover 4. Typically, the micro-perforated sheet 12 is omitted when the capsule 1 is intended for the production of beverages obtained from soluble substances.

The filter member 9 comprises a relatively rigid disk 13, which is firmly coupled to the lateral wall 6, has a top face 14 facing the chamber 10 and a bottom face 15 facing the chamber 11, and is provided with a specified number of through-openings 16 extending between the top and bottom faces 14 and 15.

Depending on the type of beverage that the capsule 1 is intended to produce, the openings 16 of the disk 13 can have different shapes and sizes. Purely by way of example, in the capsule shown in FIG. 3 and partially in FIG. 4, the openings 16 are defined by a plurality of holes grouped into rows that are evenly distributed radially on a central annular portion of the disk 13. According to a variant shown in FIG. 20, the openings 16, instead, are defined by a number of cross notches distributed about the axis 3.

The disk 13 can be firmly coupled to the lateral wall 6 by wedging, gluing or in any other manner suitable for the purpose.

According to a preferred embodiment shown in FIG. 3, the disk 13 has a peripheral portion 17, which is peripherally bounded by an edge contacting the lateral wall 6, and rests on a shoulder 18 which, in the example shown, is defined by a flat annular portion of the lateral wall 6 lying on a plane transverse to the axis 3. According to variants not shown, the shoulder 18 may be defined by an annular recess of the lateral wall 6 or by an annular projection of the inner surface of the lateral wall 6.

To keep the disk 13 firmly in contact with the shoulder 18 of the lateral wall 6 and prevent it, during use, from lifting and moving towards the inside of the chamber 10, the lateral wall 6 is provided with a retaining member which at the top engages the peripheral portion 17 of the disk 13 and is defined by an annular projection 19 protruding inwards, namely towards the inside of the capsule 1.

According to the preferred embodiment of the illustrated example, the annular projection 19 is formed by an annular recess of the lateral wall 6; alternatively, the annular projection 19 may be formed by an annular projection integral with, and protruding from, the inner surface of said lateral wall 6.

As shown in FIGS. 1 and 3, the disk 13 ideally divides the cup-shaped body 2 in two parts: an upper part 2*a*, which encloses the chamber 10 and is externally bounded by the cover 4 and by an upper portion of the lateral wall 6, hereinafter referred to as the wall 6*a*; and a lower part 2*b*, which encloses the chamber 11 and is externally bounded by a lower portion of the lateral wall 6 and by the bottom wall 7, as a whole hereinafter referred to as the wall 6*b*.

The disk 13 of the filter member 9 is fitted with a tip 20, which protrudes coaxially with the axis 3 downward from the face 15 of the disk 13 and serves the purpose, during use, of perforating a sealing film 21 welded on the inner side of the bottom wall 7 in front of the opening 8, so as to allow the beverage to flow out through the beverage outflow opening 8.

To this end, the tip 20 has a height, as measured parallel to the axis 3, that is smaller than the distance between the face 15 and the sealing film 21, and the lower part 2*b* of the cup-shaped body 2 is designed to get deformed in a relatively elastic manner in the direction of the axis 3 when the capsule 1, during use, is closed in the seat of the automatic beverage preparation device, in ways that will be better illustrated hereinafter, so as to bring the tip 20 to engage and tear the sealing film 21.

In particular, according to the preferred embodiment shown in FIG. 3, the lower part 2*b* of the cup-shaped body 2 is designed to get locally deformed in a geometric discontinuity area of the lower part 2*b* of the cup-shaped body 2, in particular a change in shape and/or diameter of the wall 6*b* that bounds the lower part 2*b*.

In the illustrated example, the geometric discontinuity is defined by a connection 22 adapted to connect two portions of the lower part 2*b*: an enlarged or wider portion 23 arranged immediately below the disk 13, and a restricted or narrow portion 24 extending from the wider portion 23 towards the bottom wall 7, to which it is directly or indirectly connected.

The connection 22 is defined by an area of the wall 6*b*, which bends inwards, namely towards the inside of the capsule 1, and is arranged between a flat annular area 25, which lies on a plane substantially transverse to the axis 3 and inferiorly bounds the wider portion 23, and a generally frustoconical or cylindrical area 26 that laterally bounds the narrower portion 24.

Advantageously, the connection 22 has a relatively high curvature, i.e. a relatively small radius of curvature, so that when the capsule 1 is axially compressed, the compression stresses converge on the connection 22 and the lower part 2*b* of the cup-shaped body 2 gets locally deformed in the area between the wider portion 23 and the narrower portion 24, leaving the rest of the lower part 2*b* substantially undeformed.

As shown in FIG. 3, the bottom wall 7 comprises an annular portion 27 extending in a plane generally transverse to the axis 3 and a central cup-shaped extension 28 open at the bottom via the beverage outlet opening 8. The sealing film 21 is suitably shaped to adapt to the shape of the bottom wall 7. In the example shown, the sealing film 21 has a concave central portion, which engages the cup-shaped central extension of the bottom wall 7, and an annular flange welded to the inner surface of the annular portion 27 of the bottom wall 7.

As shown hereinafter, the bottom wall 7 and, therefore, the sealing film 21 may have different shapes from those described above, provided that the bottom wall 7 has an annular portion 27 adapted to define a support base of the capsule 1 when the latter is accommodated in the seat of the beverage production device.

Figure 4:
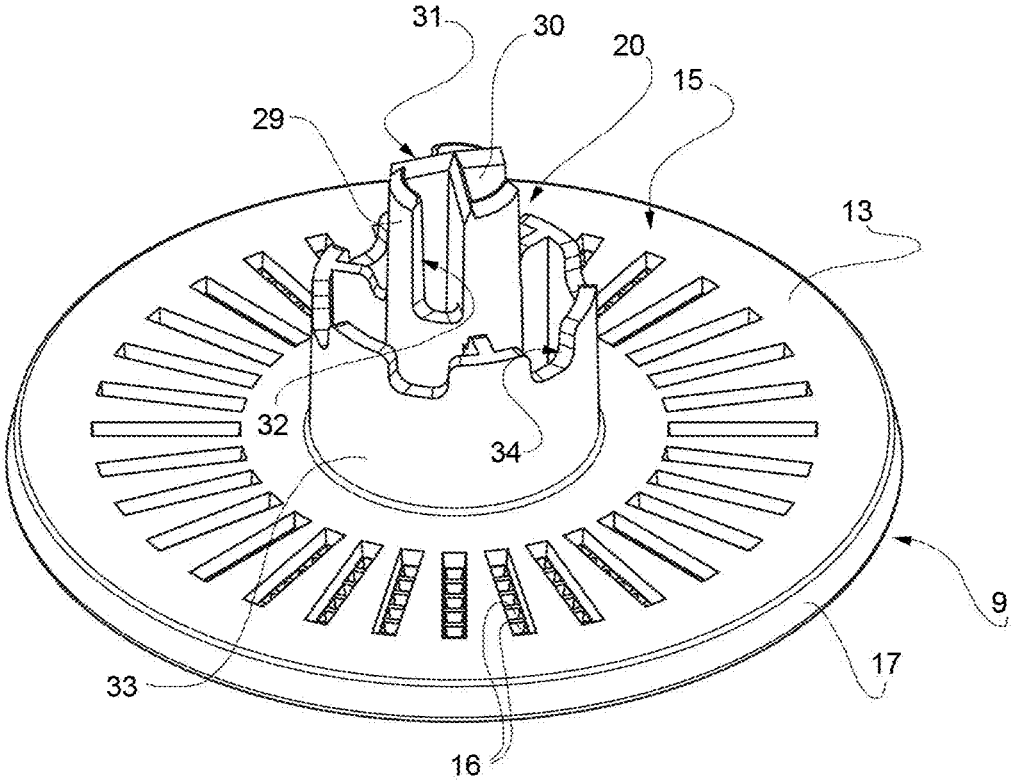
FIG. 4 is a perspective view of a first detail of FIG. 2.

As shown in FIGS. 3 and 4, the tip 20 comprises a tubular member 29 coaxial with the axis 3 and internally divided into three longitudinal channels by three radial baffles 30, which extend throughout the length of the tubular member 29 and each have a cutting end edge defining, with the end edges of the other baffles 30, a triple-edged blade 31.

According to a variant not shown, the number of baffles 30 may differ from, in particular, be greater than, the example described above.

The sectors in which the tubular member 29 is divided communicate with the outside not only through the open end of the tubular member 29, but also through respective openings 32, which are formed through the lateral wall of the tubular member 29 at the end portion of the latter, and as will be described more in detail below, serve the purpose of favouring the outflow of the beverage.

The tip 20 finally comprises a sleeve 33, which is coaxial with the axis 3, extends, starting from the disk 13, around a first portion of the tubular member 29 arranged between the disk 13 and the openings 32, and is provided, along its free edge, with a plurality of recesses 34.

The shape and size of the tip 20 may vary with respect to those in the embodiment described above and shown in FIGS. 1-7. In general, the tip 20 is sized in proportion to the length of the lower part 2*b* of the cup-shaped body 2 so that when the capsule 1 is compressed at the percolation seat, the blade 31 is lowered sufficiently to tear the sealing film 21 and, preferably, but not necessarily, the free lower edge of the sleeve 33 rests on the bottom wall 7.

Figure 8:
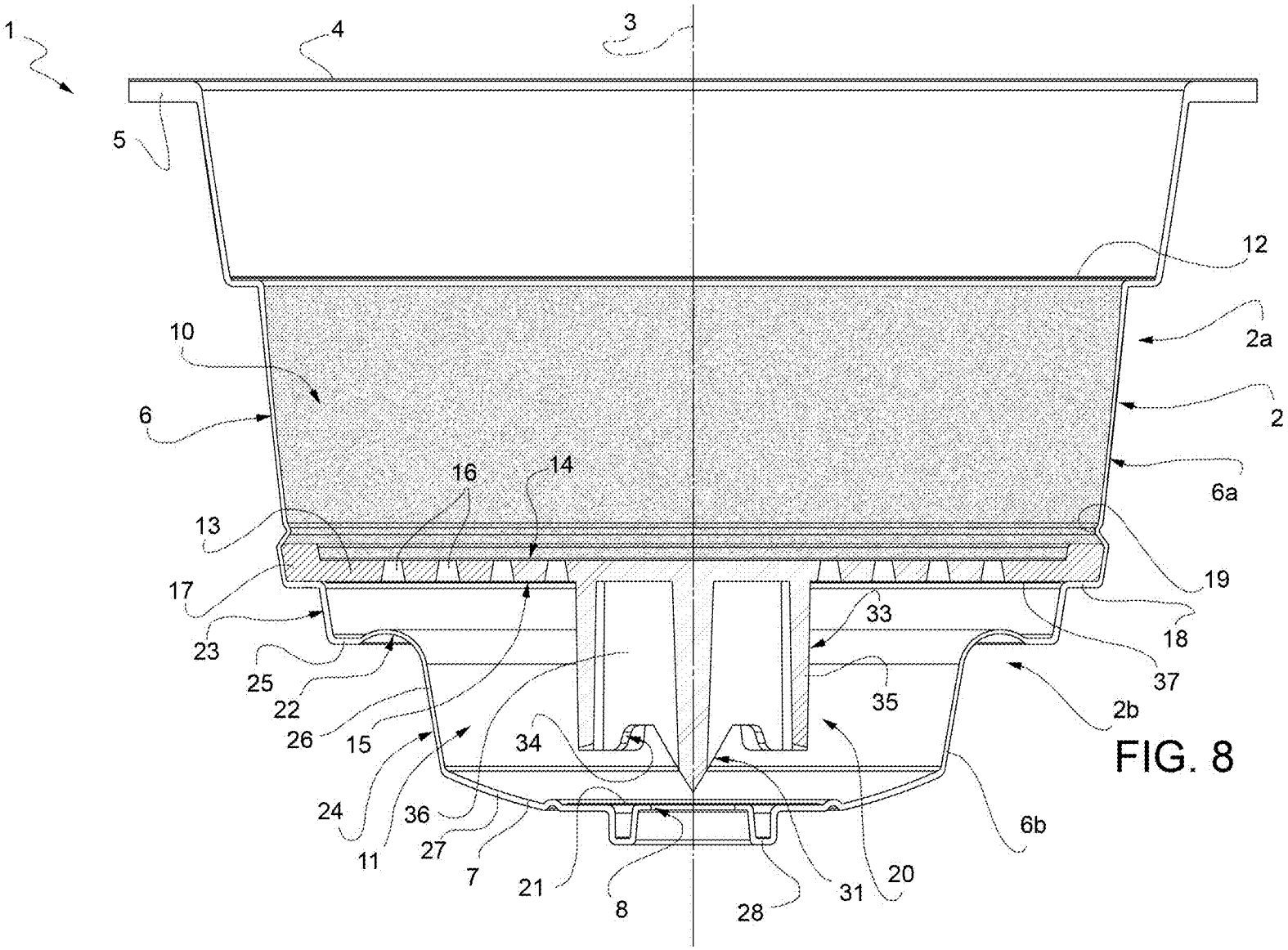
FIG. 8 is a longitudinal section of a variant of the capsule of FIG. 3.

FIG. 8 shows a variant of the capsule 1 of the example described above, which is different from the latter substantially as regards the shape of the lower part 2*b* and of the tip 20. In particular, the cup-shaped central extension 28 of the bottom wall 7 has a shorter length and has the shape of a tubular element whose open end facing the interior of the capsule 1 defines the opening 8. The sealing film 21 consists of a flat disk peripherally welded to the inner surface of the bottom wall 7.

Moreover, as shown in FIGS. 8 and 10-12, in this variant of the tip 20, the sleeve 33 is defined by three curvilinear plates 35 evenly distributed around the axis 3 and separated from one another so as to define therebetween several passages having the same function as the above-mentioned recesses 34. The interior of the sleeve 33 is longitudinally divided into three outflow channels by three radial baffles 36, the free end of which axially projects beyond the sleeve 33 and defines the triple-edged blade 31. Each baffle 36 is connected to an intermediate point of a respective curvilinear plate 35 so that each outflow channel is laterally open through the corresponding recess 34 in order to facilitate the outflow of the beverage.

According to non-illustrated variants, the number of baffles 36, curvilinear plates 35 and outflow channels can be higher or lower than that of the example described above.

Figure 9:
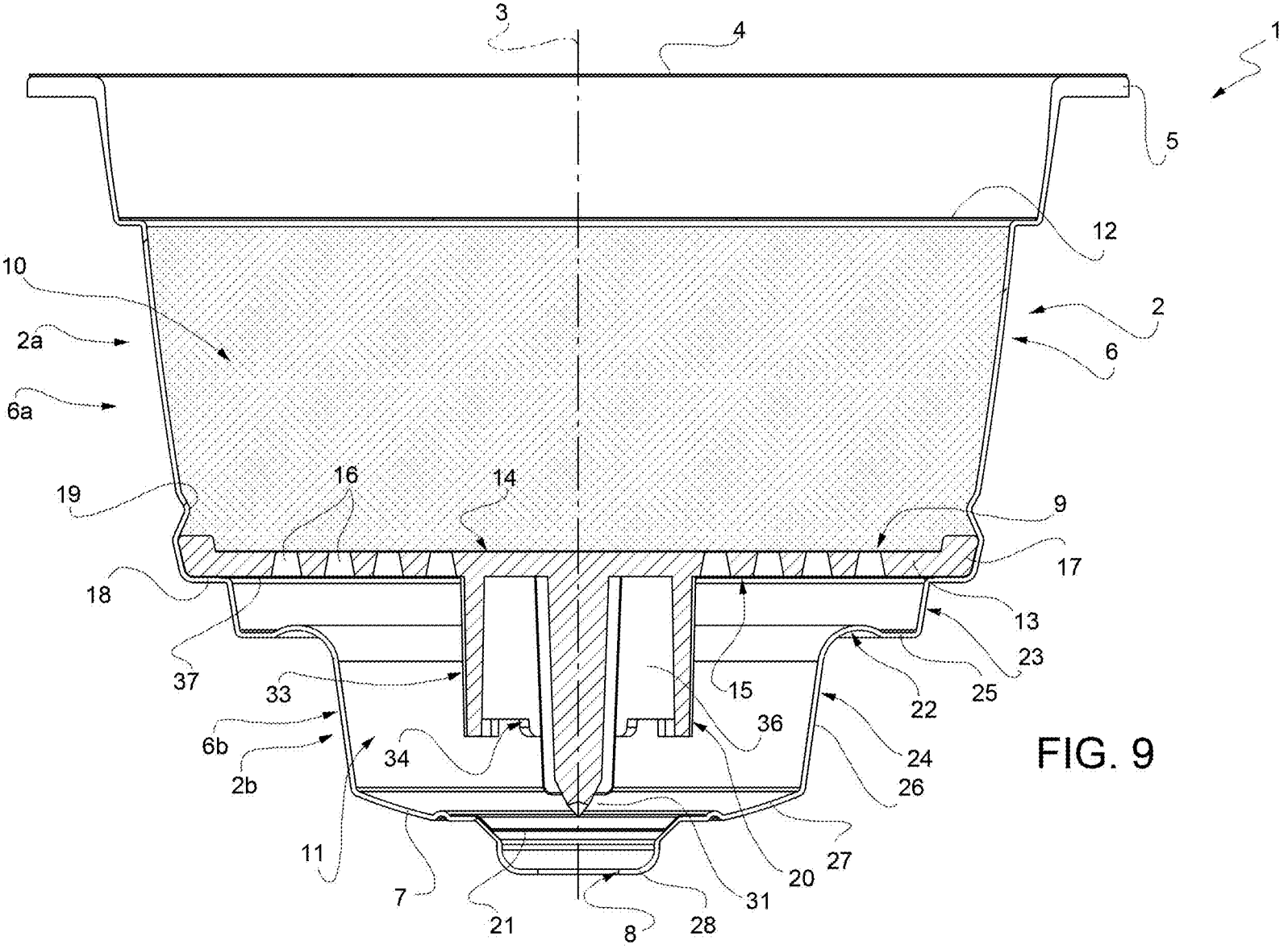
FIG. 9 is a longitudinal section of a further variant of the capsule of FIG. 3.
Figure 10:
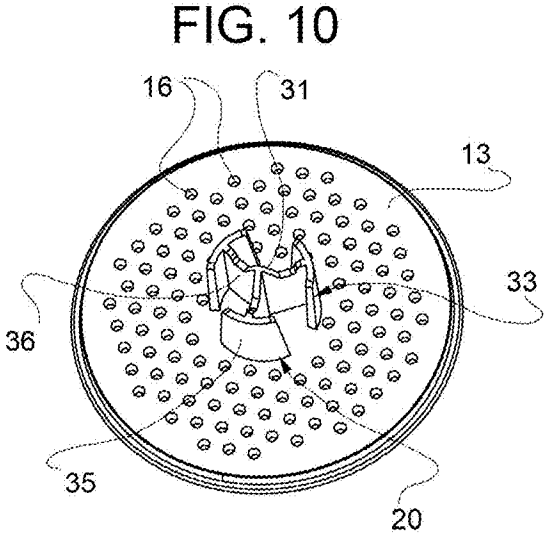
FIGS. 10, 11 and 12 are perspective views of three variants of the detail of FIG. 4.

FIG. 9 shows a further variant of the capsule 1, wherein the tip 20 is structurally similar to that of the variant of FIG. 8, while the bottom wall 7 has a cup-shaped central extension similar to that of the capsule of FIG. 3.

Regardless of the shape of the tip 20, the disk 13 is also provided with a sheet member connected to the side 15 of the disk 13 itself.

As shown in FIGS. 2 and 3, the sheet member is defined by a membrane 37, which, for example, is made of aluminium, has an annular shape, is fixed to the face 15 of the disk 13 by welding or gluing, and extends around the tip 20 and in front of the openings 16 to seal the chamber 10.

Of course, the membrane 37 may be welded onto the entire surface of the face 15 of the disk 13 with the exclusion of the openings 16 or, for example, only along a peripheral edge thereof or along the peripheral edge and at other dot-like or differently-shaped areas of the face of the membrane 37 facing the disk 13.

As shown in FIG. 3, the outer diameter of the membrane 37 is advantageously such that the whole face 15 of the disk 13 is covered by the membrane 37. According to other embodiments, not shown, the outer diameter of the membrane 37 can be smaller than that of the illustrated example, provided that the membrane 37 is sufficiently sized to cover all the openings 16 of the disk 13.

Figure 13:
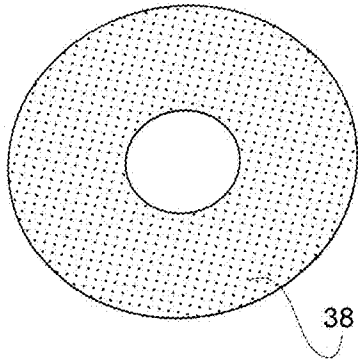
FIGS. 13 and 14 are perspective views of two variants of a second detail of FIG. 2.

According to the variant shown in FIG. 13, the aforementioned sheet member is defined by a membrane 38 provided with a plurality of micro-perforations configured to allow the beverage to flow through when the pressure in the chamber 20 is at least equal to a given threshold value.

Figure 14:
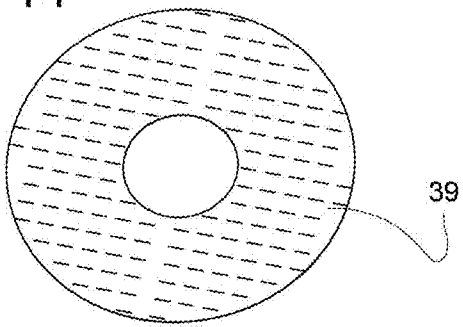

According to the variant shown in FIG. 14, the sheet member is defined by a membrane 39 provided with a plurality of cuts, which are preferably obtained by laser cutting and are configured to open when the pressure inside the chamber 10 is at least equal to the above-mentioned threshold value.

With regard to the micro-perforated membrane 38 and the micro-cut membrane 39, it should be pointed out that even if in these cases the membrane welded below the disk 13 fails to seal the chamber 10 because of the micro-holes and cuts, the latter are sized so as to bring about a relatively high outflow resistance along the exit path of the flow and open only when the pressure in the chamber 10 reaches a predetermined value to allow the beverage to flow out. In this way, the membrane 38 or 39, similarly to the membrane 37, ensures a phase of pre-brewing of the beverage, wherein the whole substance to be brewed contained in the chamber 10 is reached and permeated by the brewing fluid.

It is also important to note that even in the presence of the membrane 38 or 39, the chamber 10 is still protected from moisture and dust from the outside. Such protection is guaranteed by the presence of the sealing film 21 that, in addition to protecting the chamber 10, also protects the tip 20 from contamination by any external agent, thereby ensuring the cleanliness of all the internal parts of the capsule 1, and not only, of the chamber 10.

Figure 11:
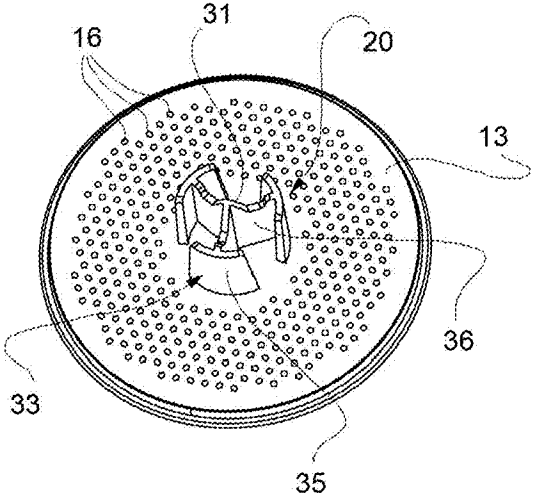
Figure 12:
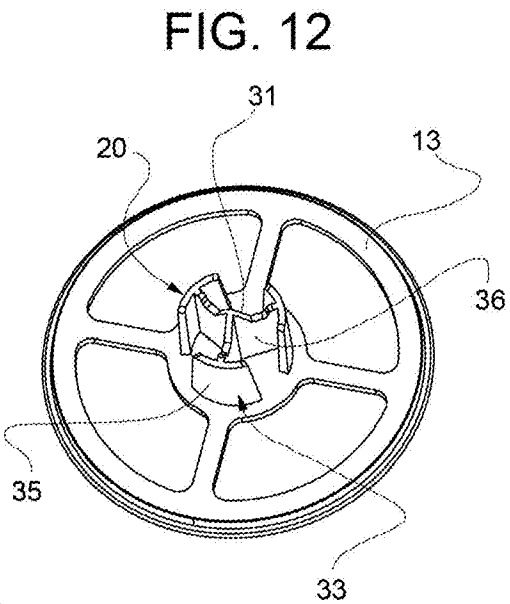

The choice of which type of membrane to apply to the disk 13 is made on the basis of the type of beverage that the capsule 1 is designed to produce and of the type of disk 13, i.e. of its openings 16. In this respect, FIGS. 11 and 12 illustrate two possible variants of the disk 13 in which the openings 16 consist of relatively small holes (FIG. 11) and large slots (FIG. 12). In the latter case, the disk 13 serves only for supporting the tip 2 or for perforating.

Finally, as illustrated in FIGS. 15-21, said sheet member can be defined by two membranes 40 and 41, which are facing one another and in direct contact with each other and are rigidly coupled to the disk 13 in various ways that will be described below.

The membrane 40 is interposed between the disk 13 and the membrane 41 and serves the purpose of sealing the chamber 10 containing the substance to be brewed, and of being torn, during use, following the feeding of the brewing fluid, when the pressure inside the chamber 10 reaches a given threshold value.

Preferably, the membrane 40 is formed from an aluminium film with varying thickness depending on the beverage to be dispensed, but can be formed from a film of any other material, for example a polymeric material or a multilayer, provided that such material has technical features such as to allow for the tearing of the membrane 40 once the aforesaid threshold value of the pressure inside the chamber 10 has been reached.

In particular, the membrane 40 has the shape of an annular membrane extending around the tip 20 in a position coaxial with the axis 3 so as to close the openings 16. According to variants not shown, the shape and the size of the membrane 40 may vary from those of the example shown in the attached figures. In general, the extension of the membrane 40 may cover all or only part of the face 15 of the disk 13, provided that it is sufficient to cover the areas of the disk 13 having the openings 16.

Preferably, the inner membrane 40 is bound to the disk 13 by welding, however other stable connection systems, for example gluing, may be used for this purpose. Moreover, the welding of the membrane 40 may be carried out by means of different embodiments, for example by welding over the entire face 15 of the disk 13 (not shown) or by means of a continuous weld along the outer and inner edges of the membrane 40, as shown in FIGS. 16 to 19.

The outer membrane 41 has the shape of an annular membrane extending around the tip 20 in a position coaxial with the axis 3 and covers the entire outer face of the membrane 40. The membrane 41 can be made of an aluminium film or a polymeric material film or a multilayer aluminium/polymeric material film depending on the type of beverage intended for the capsule 1. In this case, too, the thickness of the membrane may vary according to the beverage. The membrane 41 is adapted to be connected to the disk 13 or the membrane 40 preferably by welding, although it is possible to use any other known technique suitable for the purpose, and the welding can be carried out in three main ways:

a) the membrane 41 is connected directly to the disk 13;

b) the membrane 41 is connected to the membrane 40;

c) the membrane 41 is connected in part directly to the disk 13 and, in part, to the membrane 40.

FIGS. 15 to 19 illustrate a few possible embodiments of the connection mode under item 'a' in the above list. In all these embodiments, the membrane 40 is directly welded to the disk 13 by means of continuous welds along the respective outer and inner edges. Preferably, the membrane 40 will have to be suitably dimensioned to leave the outer and inner annular areas of the disk 13, on which the membrane 41 must be welded, uncovered. To this end, the membrane 40 has a smaller outer diameter and a larger inner diameter compared to an outer diameter and an inner diameter, respectively, of the membrane 41, so that the peripheral edges of the two membranes do not overlap.

Figure 16:
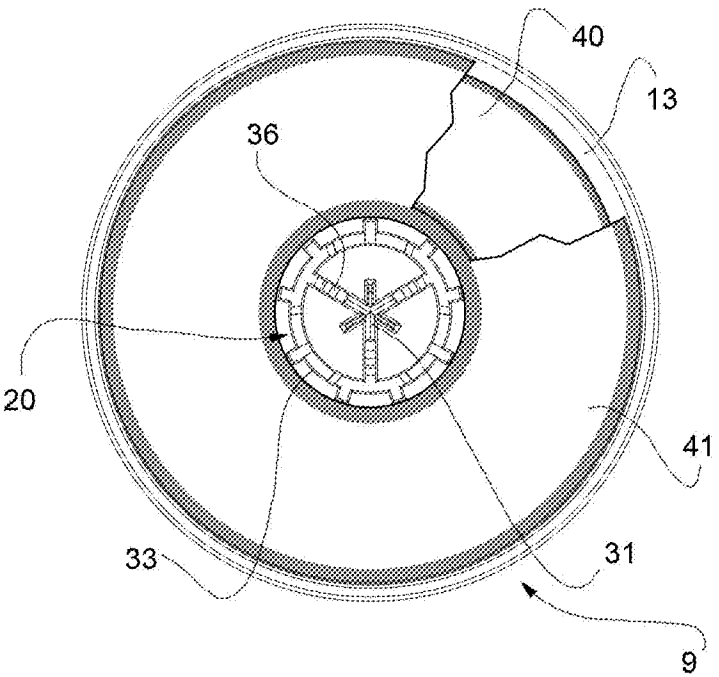
FIG. 16 is a plan view of the detail of FIG. 15.
Figure 15:
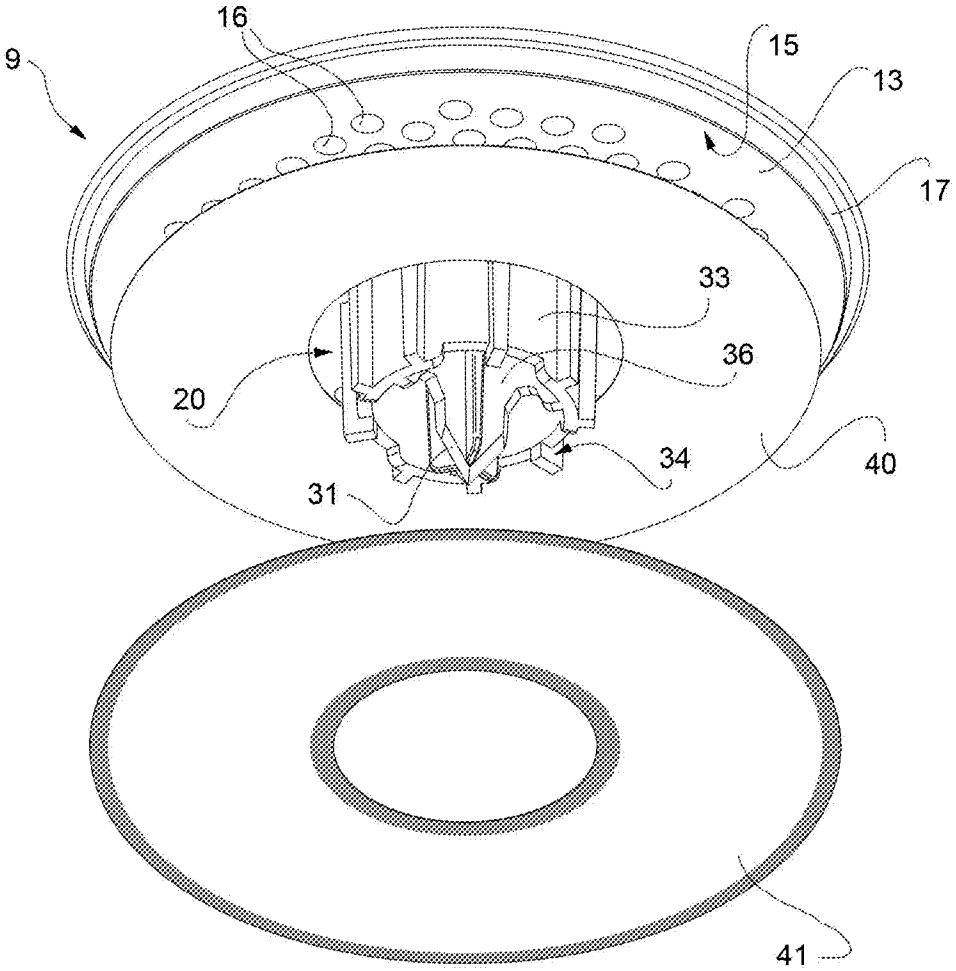
FIG. 15 is a perspective view of a variant of a detail of FIG. 2.

In FIGS. 15 and 16, the membrane 41 is directly connected to the disk 13 by means of a continuous weld along its own outer and inner edges.

Figure 17:
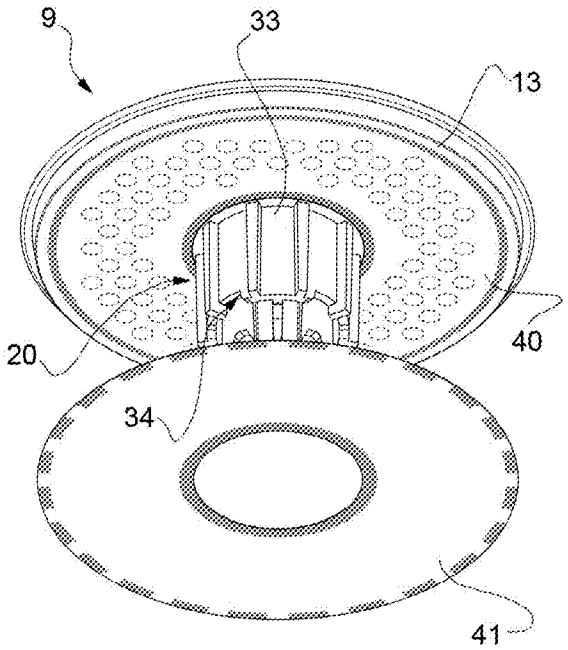

In FIG. 17, the membrane 41 is directly connected to the disk 13 by means of a continuous weld along the inner edge and a discontinuous weld along the outer edge.

Figure 18:
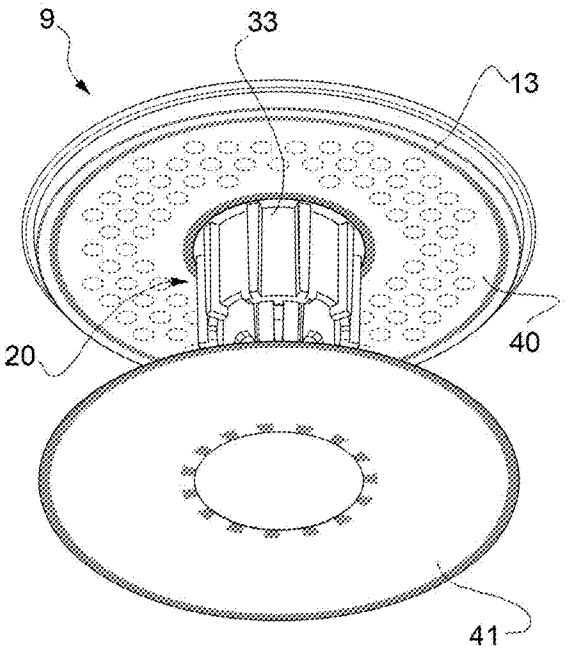

In FIG. 18, the membrane 41 is directly connected to the disk 13 by means of a continuous weld along the outer edge and a discontinuous weld along the inner edge.

Figure 19:
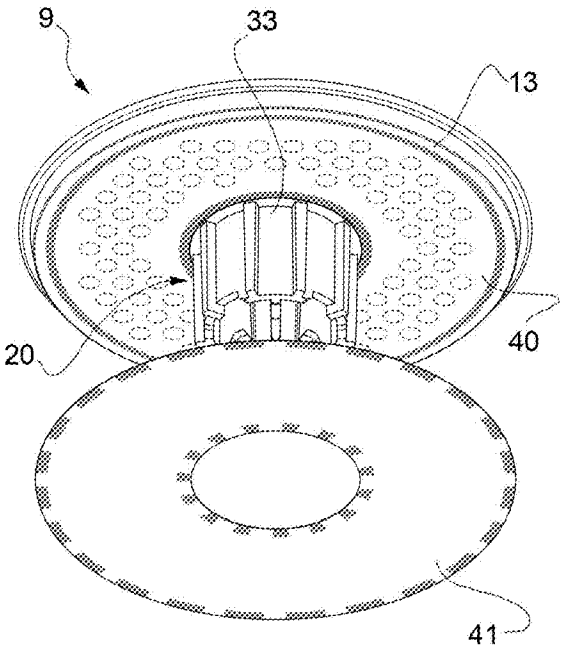
FIGS. 17, 18, 19 and 20 are perspective views of four variants of the detail of FIG. 15.

In FIG. 19, the membrane 41 is directly connected to the disk 13 by means of a discontinuous weld along both the outer and inner edges. In the cases described above in which the welding is carried out in a discontinuous manner, the morphology and the size of the welded and non-welded sectors may be manifold and are selected according to the features of the beverage to be dispensed.

Figure 21:
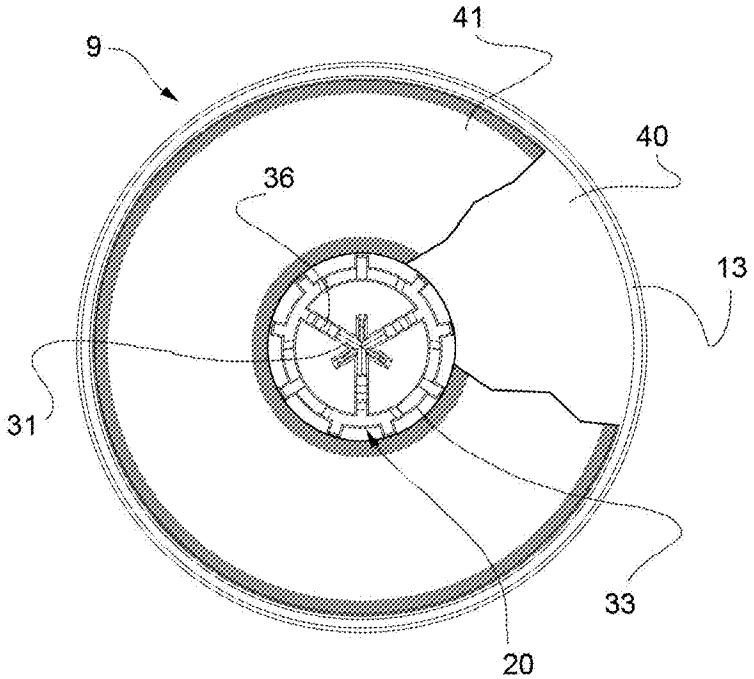
FIG. 21 is a plan view of the detail of FIG. 20.
Figure 20:
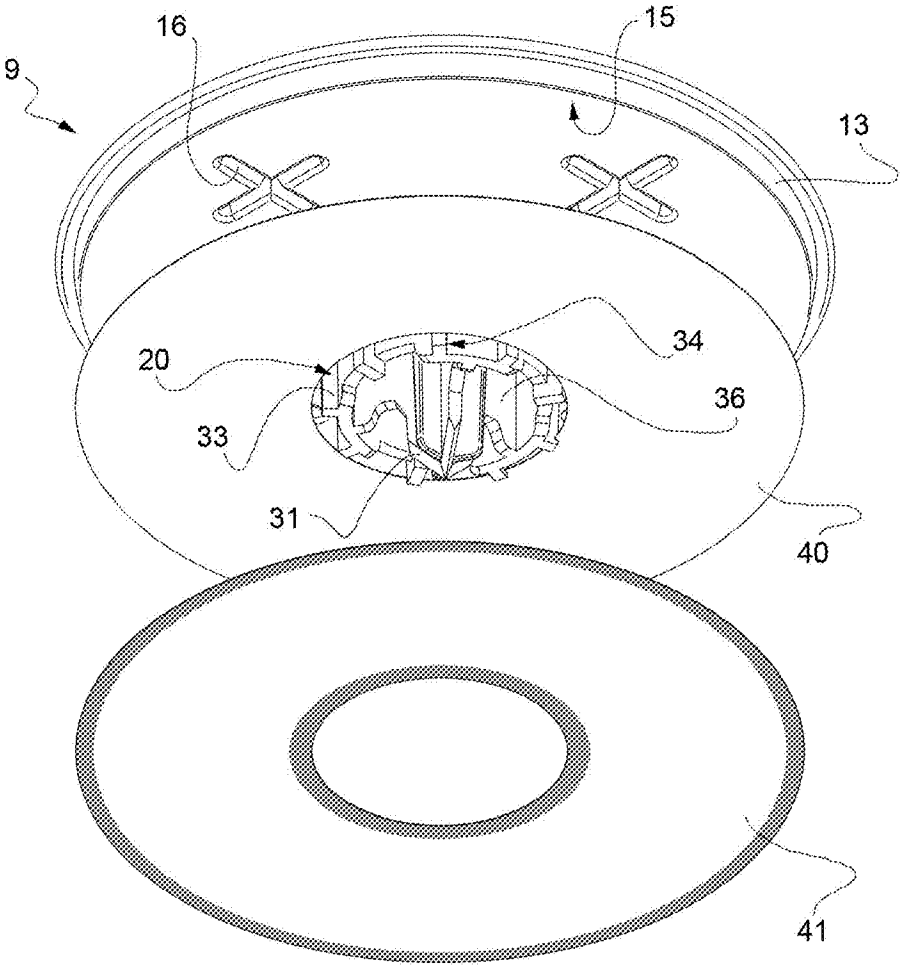

FIGS. 20 and 21 illustrate a possible embodiment of the connection mode under item b' in the above list.

In this case, the membrane 40 and the membrane 41 substantially have the same size and are simultaneously connected to the disk 13 by means of a common continuous weld formed on the outer and inner perimeters of the membrane 41.

According to a variant that can be applied to all of the embodiments described above with reference to FIGS. 16-19, the welding of the membrane 40 on the disk 13, instead of extending only along the inner and outer perimeters, may extend over the whole face 15 of the disk 13 or along the inner and outer perimeters and to sectors of any shape.

Lastly, depending on the features of the beverage to be dispensed, in particular when the capsule 1 is designed to produce a beverage by brewing, the filter member 9 of the capsule 1 may also comprise a further filter member (FIG. 2) which consists of a sheet 42 of water-permeable material, for instance a sheet of filter paper or of non-woven fibres, is arranged on the face 14 of the disk 13 in direct contact with the substance in the chamber 10, and serves the purpose of allowing the beverage to flow through and, at the same time, of preventing the residues of the brewed substance from exiting the chamber 10.

The operation of the capsule 1 is hereinafter briefly described with reference to FIGS. 5, 6 and 7.

Figure 5:
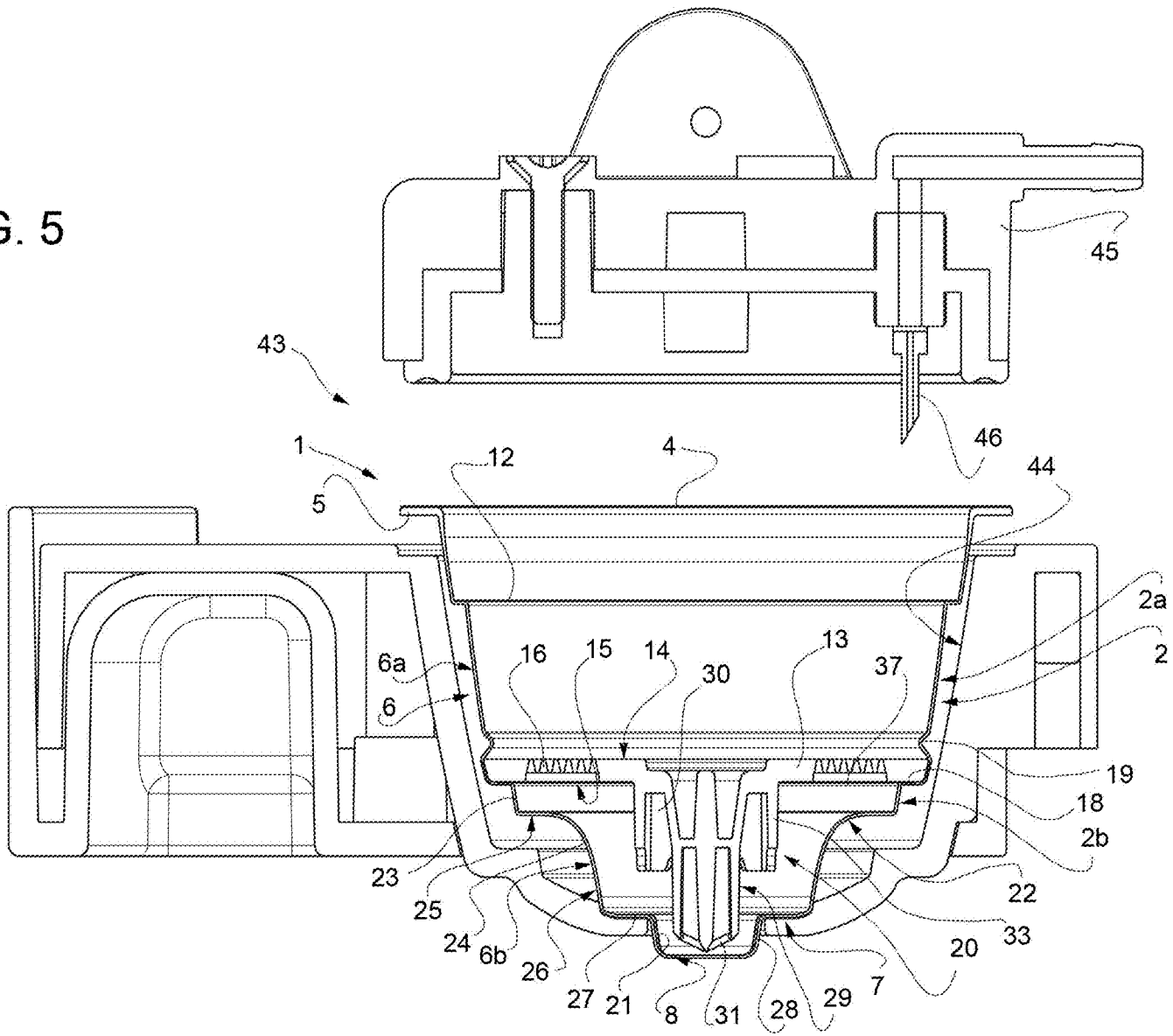
FIGS. 5, 6 and 7 are three schematic side views, with parts in section and parts removed for clarity, of a brewing assembly shown in three different operating positions of the manufacturing process of a beverage starting from the capsule of the present invention.
Figure 6:
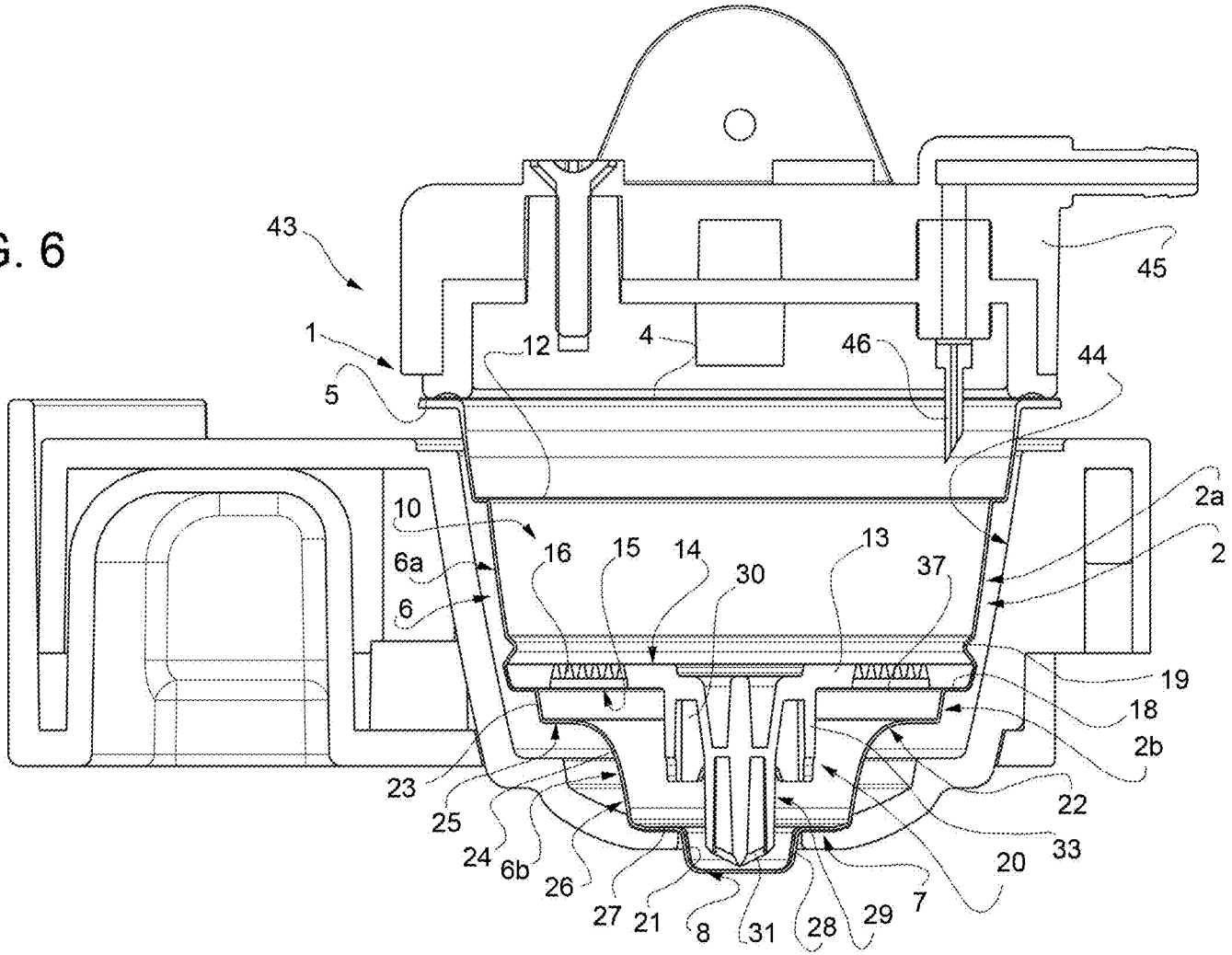
Figure 7:
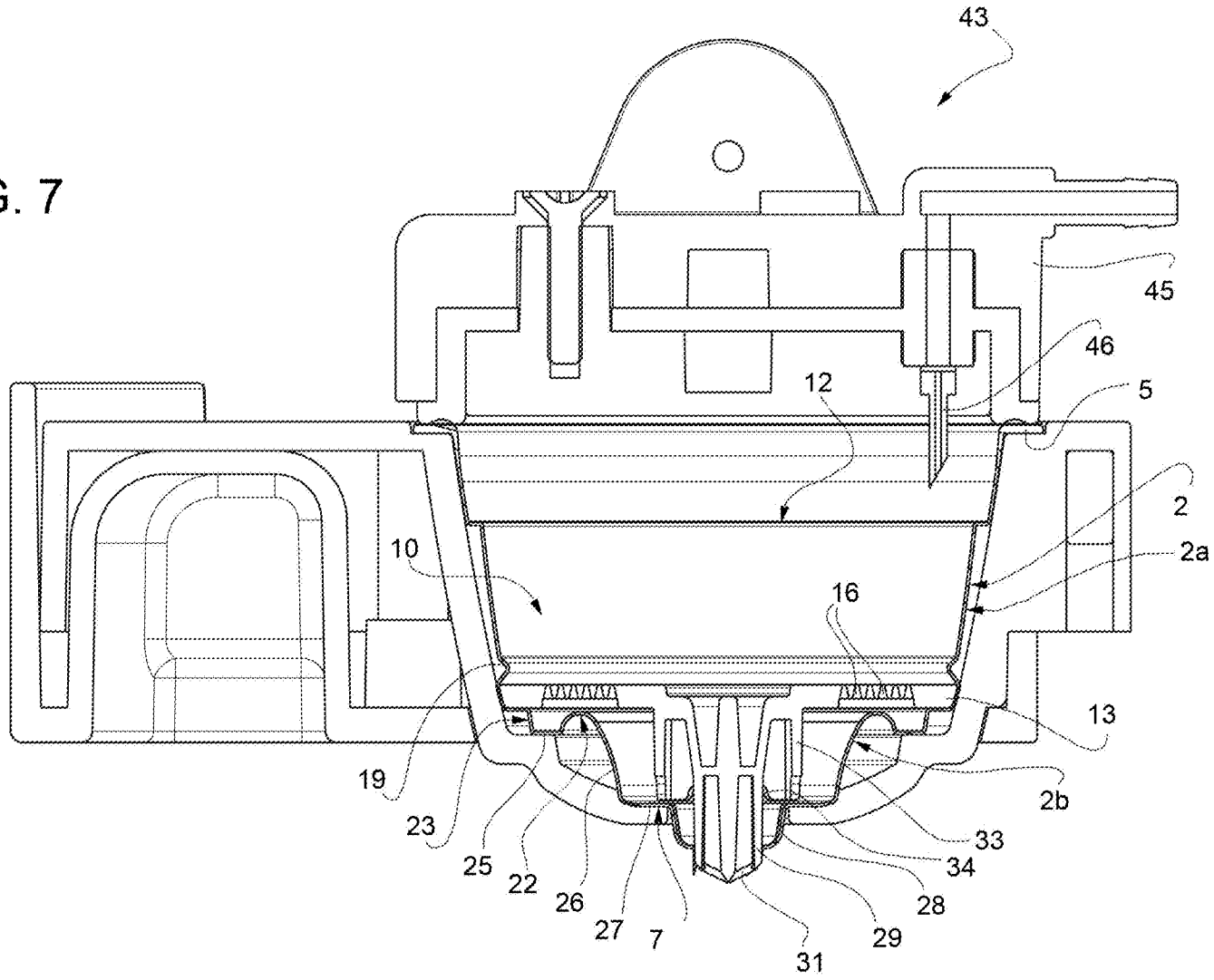

With reference to FIGS. 5 to 7, the capsule 1 is used in a brewing assembly 43 comprising a cup-shaped seat 44 adapted to receive the capsule 1, and a dispensing head 45, which is provided with a hollow feeding needle 46 protruding from the head 45 towards the seat 44 and adapted, in use, to perforate the cover 4 of the capsule 1 to supply a pressurised fluid, usually pressurized hot water, therein. The head 45 is movable with respect to the seat 44 between a rest position (FIG. 5), in which the head 45 is separated from the seat 44, and an operating position (FIG. 7), in which the seat 44 and the head 45 are coupled in a fluid-tight manner with each other.

When the head 45 is arranged in its rest position, the capsule 1 is accommodated in the seat 44 and takes an initial configuration, in which the capsule 1 is not fully inserted in the seat 32, but is arranged with its own bottom wall 7 in contact with a bottom wall of the seat 44, while the opposite end protrudes from the seat 44 (FIG. 5), with its flange 5 facing and spaced from an inlet free edge of the seat 44. The shape of the bottom wall 7 and, in particular, the presence of its annular portion 27 substantially transverse to the axis 3 ensure that, in this initial configuration, the capsule 1 takes a stable rest configuration.

Subsequently, the head 45 is first moved from its rest position to an intermediate position (FIG. 6), in which the head 45 is positioned in contact with the flange 5 and the cover 4 is perforated by the needle 46.

A further lowering of the head 45 brings the head 45 from its intermediate position to its operating position (FIG. 7), in which the seat 44 and the head 45 are coupled in a fluid-tight manner with each other, with the interposition of the flange 5.

During the shifting of the head 45 from the intermediate position to the operating position, the capsule 1 is subjected to an axial compression that causes the lower part 2*b* of the cup-shaped body 2 to collapse at the connection 22 which, as previously described, is shaped and dimensioned so as to favour convergence of the stresses in the area of the lower part 2*b* comprising it.

In particular, the substantially elastic deformation in the connection area 22 causes the formation of a bend towards the interior of the capsule 1 between the wider portion 23 and the narrower portion 24 which, then, becomes shorter but undergoes no substantial deformation in the transverse direction. Similarly, the bottom wall 7 or the part of the bottom wall 7 resting on the bottom of the seat 44 undergoes no deformation.

During compression of the capsule 1, the upper part 2*a* and the disk 13 move downwards in a rigid manner, resulting in movement of the tip 20 towards and through the beverage outflow opening 8, and tearing of the sealing film 21.

Preferably, in the deformed configuration of the capsule 1, the free end edge of the sleeve 33 of the tip 20 is placed in contact with the bottom wall 7 to stabilize the outflow channels of the tip. Preferably, moreover, the lower flat zone 25 of the wider portion 23 makes contact with a suitable shoulder of the seat 44.

Once the film 20 has been perforated and the beverage outflow opening 8 opened, the pressurised hot water is fed into the capsule 1 through the needle 46 and reaches the chamber 10 which is still closed by the membrane 37.

The increased pressure in the chamber 10 causes a progressive expansion of the membrane 37 areas corresponding to the openings 16. When the pressure in the chamber 10 is at least equal to a given threshold value, which depends on the material, and the thickness and type of welding of the membrane 37, the membrane 37 areas corresponding to the openings 16 collapse, allowing the beverage to flow into the chamber 11.

In the case of the dual-membrane variants illustrated above, the breaking of the first membrane 40 allows the beverage to flow to the membrane 41. How the beverage flows downstream of the membrane 41 mainly depends on the welding pattern of the membrane 41 against the disk 13 or the membrane 40.

The beverage, after arriving at the chamber 11, enters, directly or through the recesses 34 of the sleeve 33, the openings 32 and reaches the outflow channels in the tubular member 29, and then is dispensed to the outside in the form of an ordered and gathered flow.

In the variants in which the tip 20 does not provide for the tubular member 29, the beverage flows directly, or through the recesses 34, into the outflow channels defined by the baffles 36 of the tip 20 and is then dispensed.

The invention claimed is:

1. A capsule for producing a beverage in an automatic beverage production device, the capsule comprises a cup-shaped body defined by a lateral wall and a bottom wall with a beverage outflow opening closed by a sealing film, the cup-shaped body is closed by a cover to be perforated to supply a fluid in the capsule; the capsule also comprises a filter member extending transversely to a vertical axis extending through a center of the capsule of the capsule so as to divide the internal volume of the capsule (1) in an upper chamber (10) for a beverage production substance, and a lower chamber for collecting the beverage; the filter member divides the cup-shaped body in an upper part containing the upper chamber, and a lower part containing the lower chamber, and is provided with a perforation member facing the bottom wall;

wherein the capsule is characterized in that the bottom wall defines an annular portion extending transversely to the vertical axis to define a stable support base for the capsule when the capsule is arranged in a corresponding percolation seat of the automatic beverage production device;

wherein the lower part comprises (i) a wider portion, (ii) a narrower portion between the wider portion and the bottom wall, and (iii) a geometric discontinuity area defining a connecting region between the wider portion and the narrower portion and forming a portion of the lateral wall of the lower part, the geometric discontinuity area being shaped and/or sized so as to result, when the capsule is externally axially compressed, in the lower part of the cup-shaped body deforming inwardly at the geometric discontinuity area, and in the perforation member resultingly displacing through the sealing film;

wherein the geometric discontinuity area in the lower part of the cup-shaped body is arranged at a distance from the bottom wall so as to result, when the capsule is axially compressed, in the geometry of the bottom wall remaining unchanged; and wherein the filter member comprises a disk firmly coupled to the lateral wall and having a plurality of through openings.

2. The capsule of claim 1, wherein the connecting region is defined by an inwards bending area of the lateral wall-.

3. The capsule of claim 1, wherein the filter member comprises a membrane, which is fixed to the disk on the outside of the upper chamber, extends in front of the openings, and is configured to allow the beverage to flow through the openings when the pressure in the chamber is at least equal to a given threshold value.

4. The capsule of claim 1, wherein the filter member comprises two membranes arranged in direct contact one on top of the other and coupled to the face of the disk facing the lower chamber, and wherein the membrane which is arranged between the disk and the second membrane is coupled to the disk so as to close the openings and seal the upper chamber.

5. The capsule of claim 1, wherein the perforation member is coaxial with the vertical axis and comprises a first member so shaped as to define longitudinal beverage outflow channels and provided with a cutting edge adapted to tear the sealing film when the capsule is deformed, and a second member comprising a sleeve extending around and coaxially with the first member and so shaped and sized such that, when the capsule is deformed, an axial end portion thereof is arranged substantially in contact with the bottom wall and allows the beverage to flow from the lower chamber to the first member.

6. The capsule of claim 5, wherein the first member comprises a tubular member coaxial with the vertical axis and extending through the beverage outflow opening when the capsule is deformed, and a plurality of baffles defining, in the tubular member, the beverage outflow channels and provided with sharp ends that form as a whole the cutting edge; the tubular member is provided with a plurality of openings, each connecting a respective beverage outflow channel with the inside of the capsule when the tubular member is arranged through the beverage outflow opening.

* * * * *